US005427262A

United States Patent [19]

Hanson et al.

[11] Patent Number: 5,427,262

[45] Date of Patent: Jun. 27, 1995

[54] MULTI-COMPARTMENT DRUM

[76] Inventors: Terry J. Hanson, 5408 Islehurst Ct., Raleigh, N.C. 27613; Ted E. Piatt, 1310 Apache La., Apex, N.C. 27502; Martin P. Mascianica, 7600 Amesbury Dr., Chapel Hill, N.C. 27514

[21] Appl. No.: 188,822

[22] Filed: Jan. 31, 1994

[51] Int. Cl.[6] ..... B65D 21/00

[52] U.S. Cl. ..... 220/23.4; 220/4.04

[58] Field of Search ..... 220/23.4, 4.04, 4.24, 220/4.27, 906, DIG. 1

[56] References Cited

U.S. PATENT DOCUMENTS

| | | | |
|---|---|---|---|
| 1,976,622 | 10/1934 | McIntyre . | |
| 2,726,004 | 12/1955 | McLeod . | |
| 2,738,893 | 3/1956 | Quinones, Jr. | 220/23.4 |
| 4,139,114 | 2/1979 | Long et al. | 220/4.27 X |
| 4,165,812 | 8/1979 | Jennison . | |
| 4,271,965 | 6/1981 | Brambley et al. . | |
| 4,656,840 | 4/1987 | Loofbourrow et al. . | |
| 4,739,894 | 4/1988 | Pender | 220/23.4 |
| 4,919,295 | 4/1990 | Hitzler | 220/906 X |
| 5,045,418 | 9/1991 | Fukuyoshi . | |
| 5,158,209 | 10/1992 | Reil et al. . | |
| 5,316,159 | 5/1994 | Douglas et al. | 220/23.4 X |

*Primary Examiner*—Steven M. Pollard

[57] ABSTRACT

A longitudinally bisected storage drum includes a pair of hemi-cylindrical drum segments each being formed by a pair of semicircular end panels which are joined to, and spaced-apart by, a side wall having a hemi-cylindrical wall section and a substantially rectangular planar wall section. The planar wall section of one drum segment defines a longitudinally oriented re-entrant groove which unites with a longitudinally oriented tongue protruding from the planar wall section of the other drum segment. Therefore, when the tongue and groove are united with one another, an overall cylindrical drum structure will result. The closely adjacent planar wall sections of each drum segment establish a diametrical parting plane when the tongue and groove are united with one another while the hemicylindrical wall segments are provided with longitudinally spaced-apart and outwardly protruding pairs of roll stops close to this parting plane. Thus, by simply reversing the vertical orientation of bungholes formed in each of the upper end panels (e.g., by rolling the drum along its cylindrical side wall until the it rests upon the other set of roll stops), the contents within the hemi-cylindrical drum segments can selectively be dispensed by positioning that segment's bunghole in the lower vertical position relative to the other bunghole.

14 Claims, 4 Drawing Sheets

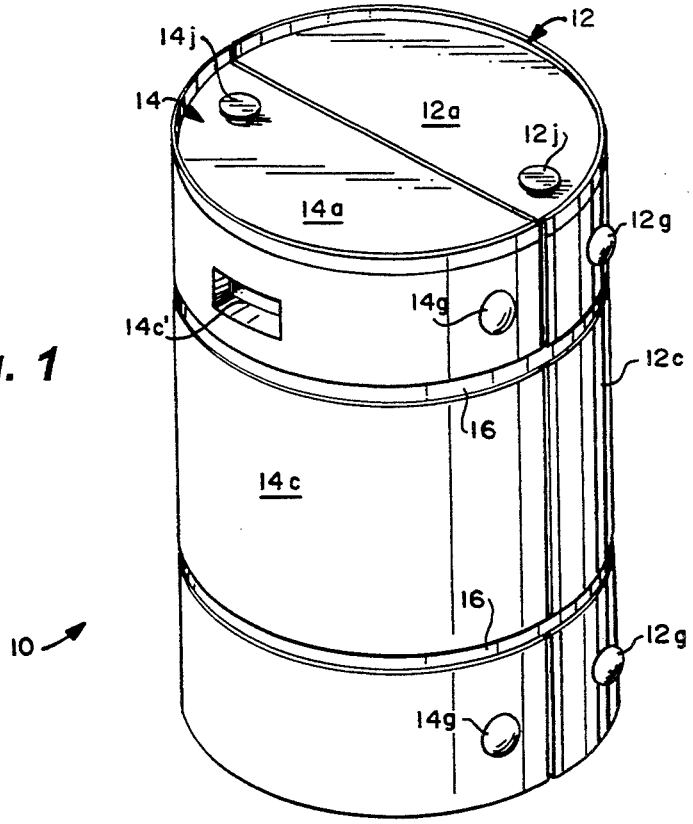
Fig. 1
Fig. 2
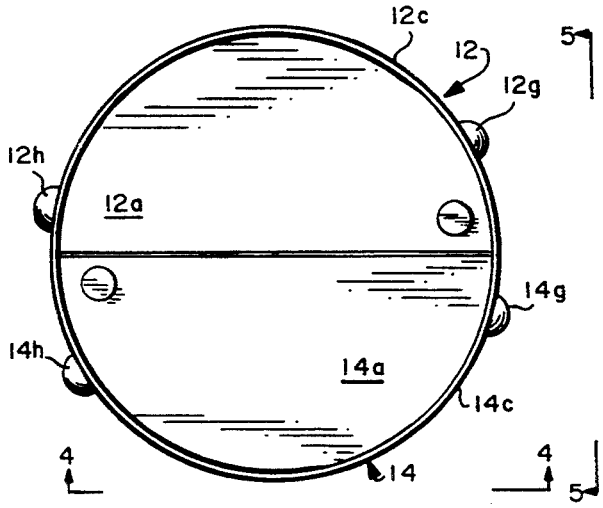
Fig. 3
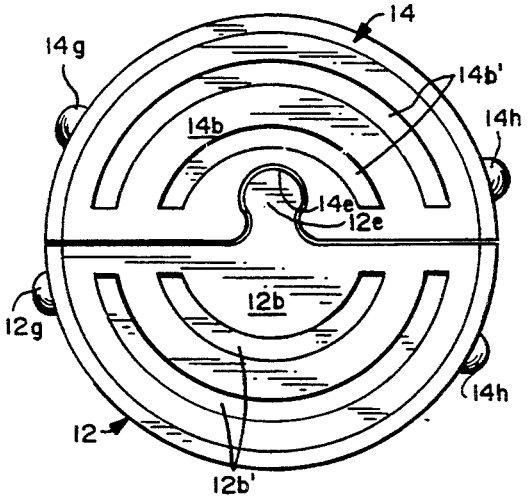

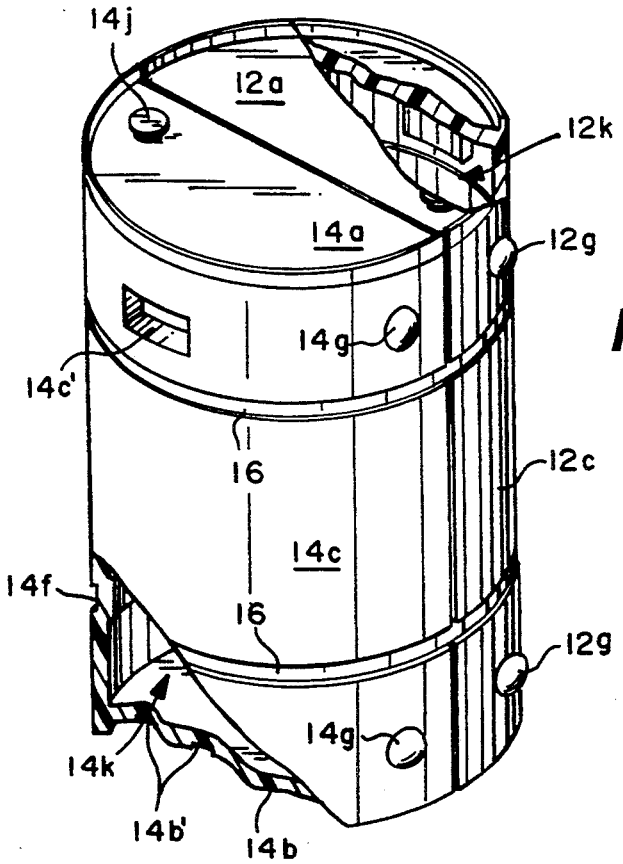
Fig. 7
Fig. 8
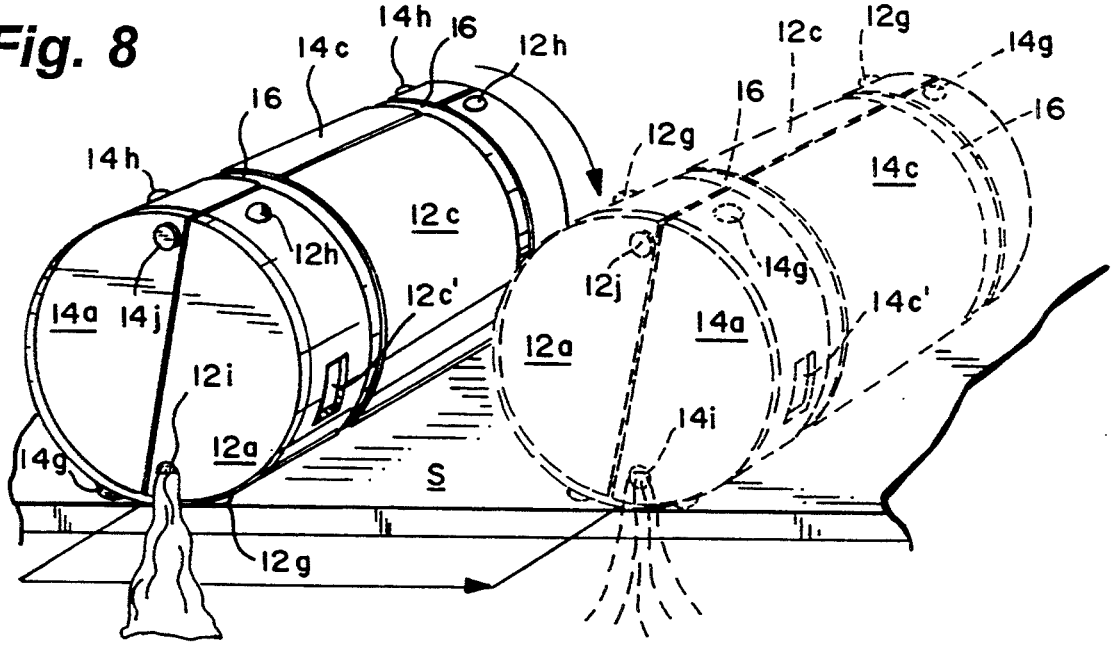

MULTI-COMPARTMENT DRUM

FIELD OF INVENTION

This invention is related to the field of storage drums. In preferred forms, the present invention is embodied in a storage drum having multiple storage compartments which allow at least two dissimilar materials (e.g., liquids, particulate solid materials, slurries or the like) to be stored separately of one another in respective ones of the compartments, but be readily available for collective use (e.g., as a mixture of such materials).

BACKGROUND AND SUMMARY OF THE INVENTION

It is sometimes desirable or necessary to supply pourable dissimilar materials (e.g., liquids, particulate solids and the like) separately to the end user even though the end user may wish to use such dissimilar materials as a mixture. For example, certain chemically and/or functionally dissimilar agricultural chemicals are desirably applied to crops as an admixture so as to improve application efficiency and/or chemical efficacy. However, it is sometimes impossible to supply such agricultural chemicals to the end user in premixed batches due to chemical instability of the mixture and/or government environmental/occupational safety requirements.

It would therefore be desirable if dissimilar materials which cannot physically be stored in admixture could nonetheless be contained separately in a common storage drum so that the end user could readily dispense such materials as needed. It is toward providing such a storage drum that the present invention is directed.

In general, the present invention is embodied in a longitudinally bisected storage drum composed of a pair of hemi-cylindrical drum segments. Thus, each drum segment will be formed by a pair of semicircular end panels which are joined to, and spaced-apart by, a side wall having a hemi-cylindrical wall section and a substantially rectangular planar wall section. The planar wall section of one drum segment (the female drum segment) will, moreover, define a longitudinally oriented re-entrant groove which unites with a longitudinally oriented tongue protruding from the planar wall section of the other drum segment (the male drum segment). Therefore, when the tongue and groove are united with one another, an overall cylindrical drum structure will result.

The closely adjacent planar wall sections of each drum segment establish a diametrical parting plane when the tongue and groove are united with one another. The hemicylindrical wall segments are provided with longitudinally spaced-apart and outwardly protruding pairs of roll stops close to this parting plane. The upper semicircular end panels are each provided with a bunghole formed in relationship to the roll stops such that, when the drum structure is turned on its side and prevented from rolling by one set of roll stops, the bungholes will be substantially vertically oriented with respect to one another.

Thus, by simply reversing the vertical orientation of the bungholes (e.g., by rolling the drum along its cylindrical side wall until the it rests upon the other set of roll stops), the contents within the hemi-cylindrical drum segments can selectively be dispensed by positioning that segment's bunghole in the lower vertical position relative to the other bunghole.

Other aspects and advantages of this invention will become more clear after careful consideration is given to the detailed description of the preferred exemplary embodiments thereof which follow.

BRIEF DESCRIPTION OF THE PREFERRED EXEMPLARY EMBODIMENTS

Reference will hereinafter be made to the accompanying drawings wherein like reference numerals throughout the various FIGURES denote like structural elements, and wherein;

FIG. 1 is a front perspective view of the multi-compartment drum according to this invention;

FIG. 2 is a top plan view of the multi-compartment drum shown in FIG. 1;

FIG. 3 is a bottom plan view of the multi-compartment drum of this invention shown in FIG. 1;

FIG. 7 is a perspective view similar to FIG. 1, but partly in section; and FIG. 8 is a perspective view illustrating the manner in which the drum contents may be dispensed.

DETAILED DESCRIPTION OF THE PREFERRED EXEMPLARY EMBODIMENTS

The accompanying FIGS. 1–7 depict a particularly preferred embodiment of the multi-compartment drum 10 according to the present invention. In this regard, the drum 10 essentially includes separable hemicylindrical drum segments in the form of male drum segment 12 and female drum segment 14. Each of the drum segments 12, 14 is comprised of a pair of semicircular upper and lower end panels **12*a*, 12*b* and 14*a*, 14*b*, joined to and separated by a side wall comprised of a hemicylindrical exterior wall section 12*c* and 14*c*, and substantially planar inner wall section 12*d* and 14*d* (see FIG. 6**), respectively.

The lower end panels **12*b*, 14*b* are preferably provided with arcuate recesses 12*b*′, 14*b*′ (or ribs, if desired) for structural strength (see FIG. 3). The side wall sections 12*c*, 14*c*, on the other hand, are preferably provided with recessed handles 12*c*′, 14*c*′, respectively, to facilitate handling of the drum 10**.

Figure 4:
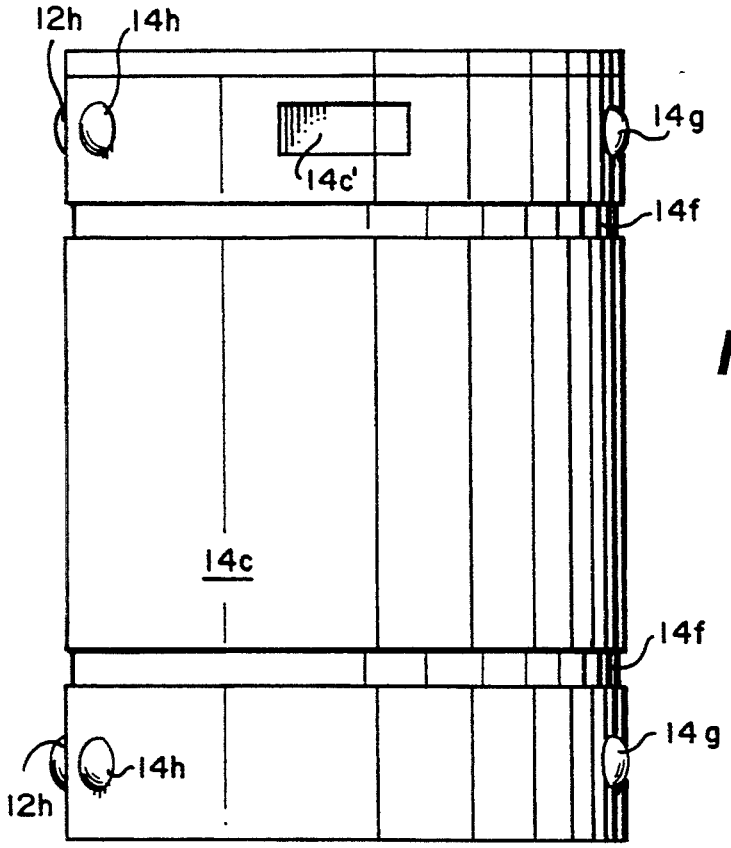
FIG. 4 is a front side elevational view of the multi-compartment drum of this invention as taken along lines 4—4 in FIG. 2.
Figure 5:
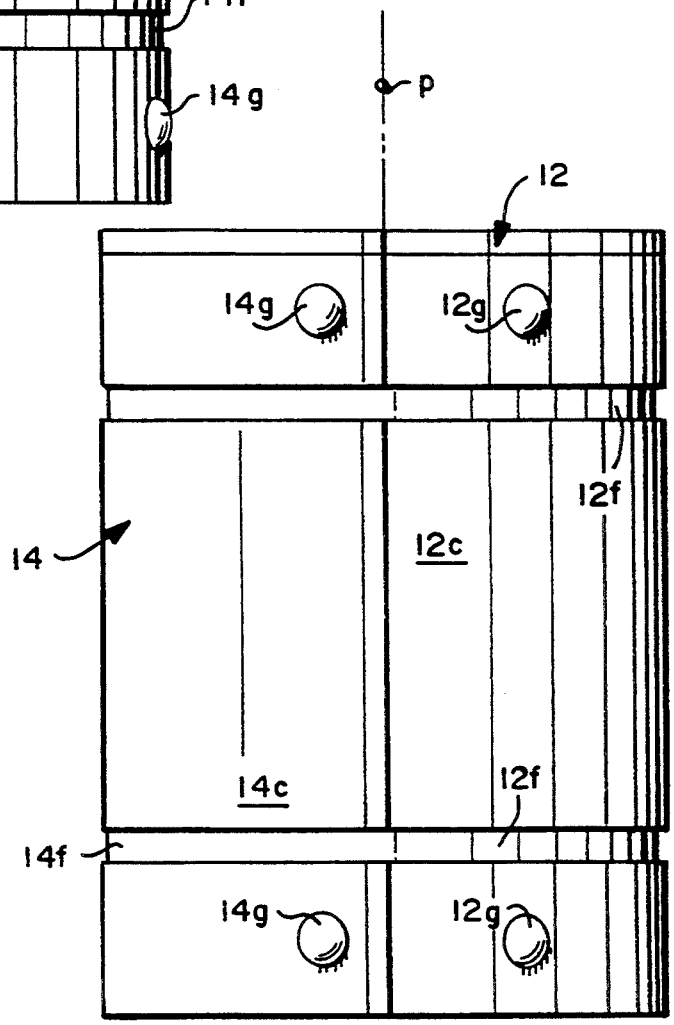
FIG. 5 is a left side elevational view of the multi-compartment drum of this invention as taken along lines 5—5 in FIG. 2.
Figure 6:
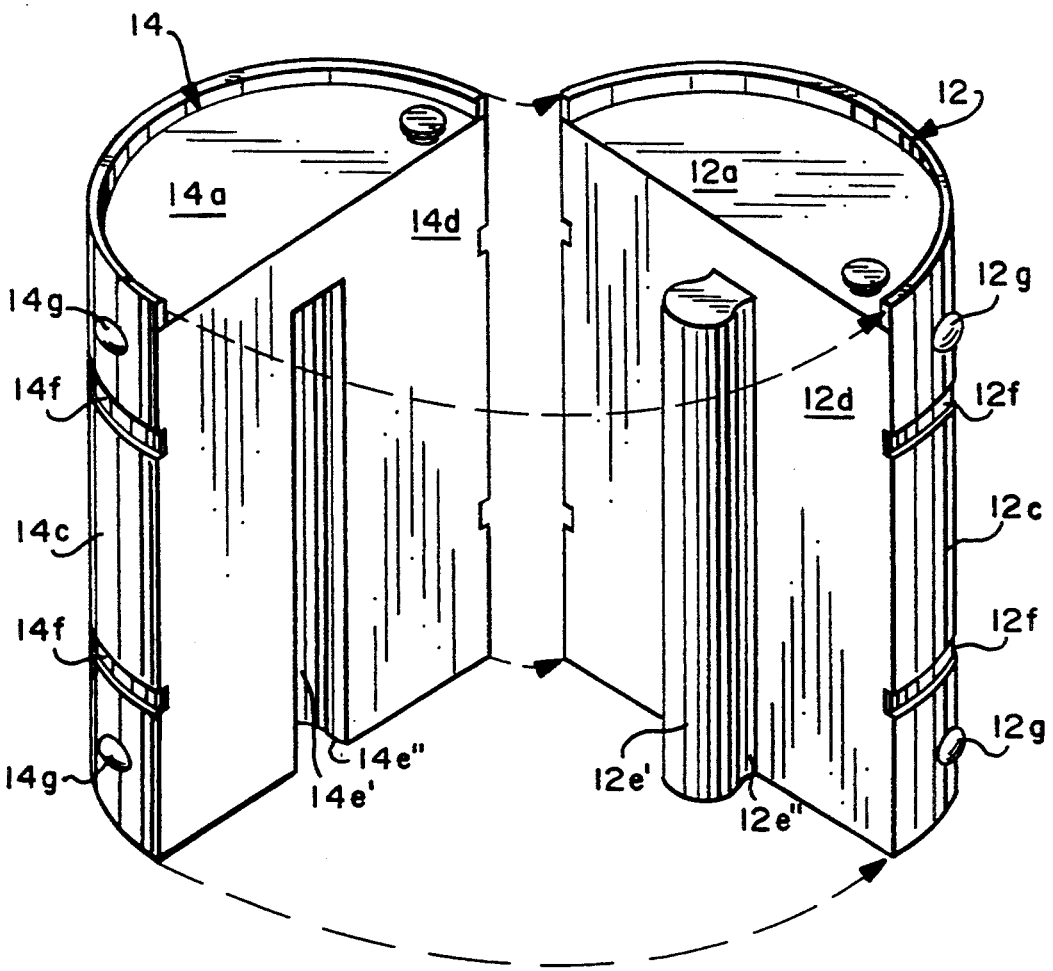
FIG. 6 is an exploded perspective view of the multi-compartment drum according to this invention showing the respective matable drum segments thereof separated in a clam-shell fashion.

As is perhaps more clearly depicted in FIG. 6, the male drum segment 12 includes a tongue **12*e* outwardly protruding from the inner wall section 12*d*, while the female drum section 14 includes a re-entrant groove 14*e* defined by the inner wall section 14*d*. The tongue 12*e* and groove 14*e* are conformably shaped so that when united, a relatively tight interference fit is achieved. In this regard, it will be noted that the tongue 12*e* includes an arcuate head portion 12*e*′ and a neck portion 12*e*″ of narrower dimension. The head portion 12*e*′ will thus fit conformably into the arcuate receiving channel 14*e*′ of the groove 14*e*, while the entranceway 14*e*″ of the groove is dimensioned so as to closely fit the neck portion 12*e*″. This interlocking arrangement of the tongue 12*e*/groove 14*e* prevents the drum segments 12/14**, respectively, from readily separating from one another.

It will be observed, however, that the longitudinal dimensions of the tongue 12*e* and groove 14*e* are each less than the overall longitudinal dimension of drum 10. This feature of the present invention will thus ensure that the two segments 12 and 14 are only united to one another in the intended orientation—i.e., mating of the drum segments in a reverse orientation to that shown in the drawing FIGURES is prevented.

Although the lower ends of the tongue 12*e* and groove 14*e* are shown in the drawing FIGURES as extending to the end (bottom) wall panels 12*b* and 14*b*, respectively, they each could terminate in a manner similar to their upper ends (i.e., each spaced from the bottom wall panels 12*b*, 14*b*, respectively). However, in the embodiment shown in the drawing FIGURES, it is preferred that the side walls 12*c*, 14*c* of the drum segments be provided with circumferential band-receiving channels 12*f*, 14*f* (see FIG. 6) which receive a suitable restraining band 16 (see FIG. 1) therein. The restraining bands 16 thereby serve to prevent relative longitudinal slippage between the drum segments 12 and 14 and may be used regardless of the particular configuration of the tongue 12*e* and groove 14*e* so as to improve the structural integrity of the drum 10 when the drum segments 12, 14 are united to one another.

The closely adjacent planar inner wall sections 12*d*, 14*d* will establish a diametrical parting plane P (which is shown normal to the plane of FIG. 5) when the tongue 12*e* and groove 14*e* are united with one another. According to the present invention, the hemicylindrical wall sections 12*c* and 14*c* will each be provided with two sets of longitudinally spaced-apart roll stops 12*g*, 12*h* and 14*g*, 14*h*, respectively. In this regard, each of the roll stops 12*g* is circumferentially opposite to a respective one of roll stops 14*g* while each of the roll stops 12*h* is circumferentially opposite to a respective one of the roll stops 14*h*. As a result, upper and lower circumferentially paired roll stops 12*g*/14*g* and 12*h*/14*h* are provided asymmetrically straddling the diametrical parting plane P when the drum segments 12 and 14 are united with one another to form the overall cylindrical drum 10. Preferably, each of the roll stops 12*g*, 12*h* and 14*g*, 14*h* will define a convexly arcuate (e.g., hemispherical) surface.

The upper end panels 12*a* and 14*a* are each provided with respective bungholes 12*i*, 14*i* (see FIG. 8) and caps 12*j*, 14*j*, respectively. The bungholes 12*i*, 14*i* thus provide access to the interior compartments 12*k*, 14*k* (see FIG. 7) of the segments 12, 14, respectively, so that the compartments 12*k*, 14*k* may be filled with a respective volume of dissimilar pourable material, and to allow a respective dissimilar pourable material contained therein to be dispensed when desired.

As noted in the accompanying drawing FIGURES, the asymmetrical orientation of the circumferentially paired roll stops 12*g*/14*g* and 12*h*/14*h* and the placement of the bungholes 12*i* and 14*i* near the paired roll stops 12*g*/14*g* and 12*h*/14*h*, respectively, allows the bungholes 12*i* and 14*i* to be vertically oriented with one another when the drum 10 is turned on its side and rests upon the paired roll stops 12*g*/14*g* or 12*h*/14*h*. Therefore, when the drum 10 rests upon a surface S using the set of paired roll stops 12*g*/14*g* as shown in FIG. 8, for example, the vertical orientation of the bungholes 12*i* and 14*i* may be reversed by simply rolling the drum 10 along its circumferential side surface (arrow $A_1$ in FIG. 8) until it translates a distance (arrow $A_2$ in FIG. 8) which is substantially equivalent one-half the circumferential dimension of drum 10, and rests upon the other set of paired roll stops 12*h*/14*h*. As such, the respective contents within the compartments 12*k* and 14*k* may be dispensed separately from the drum 10 through bungholes 12*i* and 14*i*, respectively.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A multi-compartment storage drum comprising:

a pair of separably united hemi-cylindrical drum segments;

each said drum segment including upper and lower semicircular end panels which are joined to, and spaced apart by, a side wall having a hemi-cylindrical exterior side wall section and a planar interior side wall section, wherein said end panels and said interior and exterior side wall sections of each said drum segment collectively establish a compartment to hold a volume of pourable material, and wherein said interior side wall sections of said drum segments are disposed closely adjacent to one another when said drum segments are united so that said drum has a generally cylindrical shape by virtue of said exterior hemi-cylindrical exterior side wall sections, said closely adjacent interior side wall sections establishing a longitudinally diametrical parting plane of said storage drum, and wherein said storage drum further comprises, circumferentially paired roll stops outwardly extending from said exterior side wall sections of said drum sections and asymmetrically straddling said longitudinally diametrical parting plane; and bung holes formed in each of said end panels and disposed closely adjacent said parting plane such that said bung holes are oriented substantially vertically with respect to one another when said drum is resting on one set of said paired roll stops and such that said vertical orientation of said bung holes may be reversed by rolling said storage drum along said side wall sections until said drum rests upon another set of paired roll stops.

2. A storage drum as in claim 1, further comprising a groove formed in the planar interior side wall section of one drum segment, and a tongue outwardly protruding from the planar interior side wall section of the other drum segment, said tongue and groove being conformably shaped so as to be interlockable and thereby separably unite said drum segments one the other.

3. A storage drum as in claim 2, wherein said tongue and groove are oriented longitudinally.

4. A storage drum as in claim 3, wherein at least one terminal end of said tongue and groove terminates short of an adjacent end panel.

5. A storage drum as in claim 3, wherein said tongue includes an arcuate head portion and a neck portion of reduced cross-sectional dimension joining said head portion to said planar interior side wall section of the other drum segment.

6. A storage drum as in claim 5, wherein said groove includes an arcuate receiving channel conforming to said head portion of said tongue and an entranceway corresponding substantially to said reduced cross-sectional dimension of said neck portion.

7. A storage drum as in claim 6, comprising upper and lower sets of said circumferentially paired roll stops.

8. A storage drum as in claim 7, wherein each of said roll stops defines a convex arcuate surface.

9. A storage drum as in claim 1, wherein said exterior side wall sections include handles.

10. A storage drum as in claim 9, wherein said handles are recessed.

11. A storage drum as in any one of claims 1, 2, 3 or 4, wherein said exterior side wall sections include circumferential band-receiving channels, and restraining bands disposed in said band-receiving channels to prevent relative separation of said drum segments.

12. A drum as in claim 1, wherein lower end panels include arcuate reinforcing structures.

13. A drum as in claim 12, wherein said reinforcing structures are recessed relative to said lower end panels.

14. A drum as in claim 1, further comprising caps covering said bung holes.

* * * * *